United States Patent [19]

Iijima et al.

[11] Patent Number: 4,581,067

[45] Date of Patent: Apr. 8, 1986

[54] HIGH-STRENGTH AUSTENITIC STEEL

[75] Inventors: Katsumi Iijima, Hitachi; Norio Yamada, Hitachiota; Seishin Kirihara; Masao Shiga, both of Hitachi; Masayuki Sukekawa, Kitaibaraki; Takatoshi Yoshioka; Kiyoshi Hiyama, both of Hitachi, all of Japan

[73] Assignee: Hitachi, Ltd., Tokyo, Japan

[21] Appl. No.: 547,573

[22] Filed: Nov. 1, 1983

[30] Foreign Application Priority Data

Nov. 1, 1982 [JP] Japan ..... 57-190821

[51] Int. Cl.[4] ..... C22C 38/06; C22C 38/48

[52] U.S. Cl. ..... 75/124; 75/128 N; 75/128 F; 75/128 G; 75/128 T; 75/128 V; 148/38

[58] Field of Search ..... 75/124 F, 124 C, 128 F, 75/128 N, 128 G, 128 T, 128 V, 124 R; 148/38

[56] References Cited

U.S. PATENT DOCUMENTS

| | | | |
|---|---|---|---|
| 3,759,757 | 9/1973 | Perry | 75/124 C |
| 4,172,716 | 10/1979 | Abo et al. | 75/128 N |

FOREIGN PATENT DOCUMENTS

| | | | |
|---|---|---|---|
| 620812 | 1/1963 | Belgium | 75/128 F |
| 106426 | 4/1984 | European Pat. Off. | 148/38 |
| 46-37254 | 11/1971 | Japan | 75/128 N |
| 49-7773 | 2/1974 | Japan | 75/128 N |
| 58-71363 | 4/1983 | Japan | 148/38 |

*Primary Examiner*—L. Dewayne Rutledge
*Assistant Examiner*—Deborah Yee
*Attorney, Agent, or Firm*—Antonelli, Terry & Wands

[57] ABSTRACT

A high-strength austenitic steel having a fully austenite structure and consisting essentially of 0.02 to 0.15 wt % of C, not greater than 1.5 wt % of Si, not greater than 2.5 wt % of Mn, 8 to 20 wt % of Ni, 13 to 25 wt % of Cr, 0.02 to 0.25 wt % of Al, not greater than 0.1 wt % of N, at least one of 0.001 to 0.01 wt % of B, 0.02 to 0.5 wt % of Nb, 0.01 to 0.2 wt % of Ti and 0.02 to 0.6 wt % of V and the balance substantialy Fe, with the weight ratio (Al/N) ranging between 1 and 4.5. This steel is suitable for use as the material of, for example, inner casing of steam turbine, valve body incorporated in the steam turbine, rotor shaft, and chemical equipment such as reaction pipe and vessel for styrene monomer producing facility.

7 Claims, 7 Drawing Figures

HIGH-STRENGTH AUSTENITIC STEEL

BACKGROUND OF THE INVENTION

1. Field of the Invention

The present invention relates to a novel high-strength austenitic steel and, more particularly, to a high-strength heat-resisting austenitic steel suitable for use as the material of a turbine casing and valves of a super critical pressure steam turbine which operates with steam of extremely high temperature and pressure, as well as the material of a reaction furnace of a chemical equipment which operates at high temperature such as, for example, styrene monomer synthesizing tower.

2. Description of the Prior Art

The current tendency of a shortage of petroleum resources and the rise in the price of the same have given an increase in the demand for improvement in the thermal efficiency of a steam power plant through the use of steam of higher temperature and pressure. The steam turbine of modern steam power plant operates at a steam temperature between 538° C. and 566° C. The turbine casing and valve bodies of steam turbines operable at such a high steam temperature are made from Cr-Mo-V cast steels which exhibit high resistance to heat. This type of heat-resisting cast steel, however, undesirably exhibits grain boundary slip at temperatures above 550° C. and, hence, an extremely low creep strength. For this reason, this type of cast steel cannot be used at high steam temperatures above 600° C.

Generally, heat-resisting austenitic steels such as SUS 304, SUS 316, SUS 321 and SUS 347 as specified in JIS (Japanese Industrial Standard) are used suitably at high steam temperatures exceeding 600° C. More specifically, the steels SUS 304 and SUS 316 show a $10^5$-hour creep rupture strength of 6 $Kg/mm^2$ or less at 650° C. Considering that a $10^5$-hour creep rupture strength of 7.7 $Kg/mm^2$ or higher is required under the steam condition of 600° to 650° C. and pressure of 316 to 352 atg., the steels SUS 304 and SUS 316 cannot be used under such a severe condition.

Japanese Patent Laid-Open Nos. 109421/77 and 158853/81 disclose addition of strong carbide formers such as Nb, Ti, Zr, V, etc. to heat-resisting austenitic steel to improve the high-temperature strength of such steel. These literatures, however, do not show or suggest any relationship between Al and N contents of the steel. The present inventors have found that these elements added to the steel show higher stability in the form of nitrides or carbonitrides than in the form of carbides, so that these elements tend to form nitrides or carbonitrides such as NbN, TiN, ZrN, Nb(C,N), Ti(C,N), and Zr(C,N). These nitrides and carbonitrides are substantially insoluble to the matrix. In addition, when a steel ingot of a diameter greater than 50 cm or of a weight greater than 5 tons is formed from this type of steel, these nitrides or carbonitrides exist in the form of large pyramidal crystals within the grains and grain boundaries, partly because the alloy elements tend to show segregation and partly because the rate of solidification of the ingot is low. These nitrides and carbonitrides, therefore, do not make any contribution to the increase in the strength of the alloy and, hence, the strength of the steel is not increased substantially by the addition of these carbide formers.

The heat-resisting austenitic steels strengthened by the addition of appreciable amounts of Nb, Ti, Zr and B can form comparatively small ingot having satisfactory strength because such an ingot can easily be treated at a high solid solution temperature. However, it is difficult to form a large ingot from such a steel as will be explained later. The ingot formed from such a steel with the addition of very small amounts of elements such as Nb, Ti, Zr and B exhibits impractically low strength due to the fact that most of these additives is consumed by forming nitrides and carbonitrides. In addition, the creep rupture strength is low particularly in a large-size ingot due to the segregation of the alloy elements.

These nitrides and carbonitrides exist in the grain boundaries near cracks, so that they adversely affect the fatigue life in which the crack propagates from the surface. Thus, the formation of coarse nitrides and carbonitrides is quite inconvenient for the material of steam turbine and valve body which undergoes not only creep but also thermal fatigue due to repeated start and stop of the steam turbine.

High alloys having high Cr and Ni contents, such as Incolloy 800, 15–15N and G18B are known as materials having high strength at high temperature. However, large-size steel products such as steam turbine casing, chemical equipment or the like formed by melting from such a high alloy are unsatisfactory in the strength, toughness, castability, plastic workability and weldability, because of the formation of coarse precipitates as heretofore described.

SUMMARY OF THE INVENTION

Object of the Invention

Under these circumstances, the present invention has as its primary object to provide an austenitic steel in which the formation of nitrides and carbonitrides of carbide formers which are added in very small amounts is prevented, thereby insuring high strength of the steel without imparing properties such as weldability, castability and plastic workability.

More specifically, the invention aims at providing An austenitic steel exhibiting superior castability, plastic workability that is weldability and usable as a cast material suitable for the turbine casing and valve bodies used in steam turbines which operate with steam of high temperature of 600° to 650° C. and high pressure of 316 to 352 atg., as well as forged material suited for chemical equipment which is subjected to high temperatures above 600° C.

Brief Summary of the Invention

To this end, according to the invention, there is provided a high-strength austenitic steel having a fully austenitic structure and consisting essentially of 0.02 wt% to 0.15 wt% of C, not greater than 1.5 wt% of Si, not greater than 2.5 wt% of Mn, 8 wt% to 20 wt% of Ni, 13 wt% to 25 wt% of Cr, 0.02 wt% to 0.25 wt% of Al, not greater than 0.1 wt% of N, at least one of 0.001 wt% to 0.01 wt% of B, 0.02 wt% to 0.5 wt% of Nb, 0.01 wt% to 0.2 wt% of Ti and 0.02 wt% to 0.6 wt% of V and the balance substantially Fe, with the weight ratio (Al/N) ranging between 1 and 4.5.

The invention aims to maximize the effect of addition of very small amounts of Ti, Nb, V, Zr and B so as to remarkably improve the strength of the heat-resisting austenitic steel. Since these elements are added only in very small amounts, if the steel contains nitrogen most of these elements are consumed in forming pyramidal coarse precipitates and, therefore, these elements do not make any substantial contribution to the strengthening of the steel. The present inventors have found that the impediment by the nitrogen to the strengthening of the steel is caused when the amounts of addition of these elements are very small.

This leads to an idea that, in order to maximize the effect of the strong carbide formers which are added only in a very small amount, as well as the effect of B which also is added in a very small amount to strengthen the grain boundary, it is an effective measure to add a very small amount of Al which exhibits a greater affinity to nitrogen than these elements so as to fix the nitrogen with the Al.

The addition of very small amounts of these elements produces quite a strong effect on the steel having metastable austenite phase but does not produce substantial effect on a steel having a stable austenite phase rich in Ni and so forth.

Reasons for Limitation on Respective Constituents

The C content should be at least 0.02 wt% in order to improve the tensile strength at room temperature, high-temperature strength and creep rupture strength through formation of carbides. The addition of C in excess of 0.15 wt%, however, seriously lowers the toughness and weldability of the steel. For these reasons, the C content is selected to range between 0.02 wt% and 0.15 wt%, preferably between 0.05 wt% and 0.13 wt%.

Si is an important element which is added as deoxidizer during melting. A satisfactory effect is produced by addition of not greater than 1.5 wt% of Si. An Si content exceding 1.5 wt%, however, lowers the toughness, weldability and creep rupture strength, while increasing the creep rate. The Si content, therefore, should be 1.5 wt% or less, preferably between 0.4 wt% and 1 wt%.

The Mn is an important element which serves, like in the case of Si, as a deoxidizer during melting and also as an element which improves the hot-workability. Addition of Mn in excess of 2.5 wt%, however, is not preferred because such large Mn content impairs the corrosion resistance and oxidation resistance of the steel. The upper limit of Mn content, therefore, should be 2.5 wt%. The Mn content between 1 and 2 wt% is preferable.

The Ni is also an important element for forming austenite structure. Ni content less than 8 wt% permits the formation of ferrite and causes a formation of martensite structure by a cold plastic working to make the austenite structure unstable. On the other hand, addition of 8 wt% or more of Ni improves the corrosion resistance of the steel. For these reasons, the Ni content should be 8 wt% or higher. However, addition of Ni in excess of 20 wt% undesirably decreases the hot workability and impairs the strengthening effect produced by addition of very small amounts of carbide formers. The Ni content, therefore, should be 20 wt% or smaller, preferably between 10 wt% and 15 wt%.

The Cr is an important element effective in improving the high-temperature strength, corrosion resistance and oxidation resistance. These effects become appreciable when the Cr content is 13 wt% or higher. However, addition of Cr in excess of 25 wt% deteriorates the weldability and unfavourably promotes the formation of ferrite phase to allow the formation of sigma phase during long heating at high temperature to promote embrittlement. The Cr content, therefore, should not exceed 25 wt%. Considering that any increase in the Cr content increases the thermal expansion coefficient and, hence, the thermal stress, the Cr content is selected preferably to fall within the range between 15 wt% and 20 wt%.

The Al shows a high affinity to nitogen so that it reacts with the nitrogen in the steel to fix the same thereby to maximize the effects obtained by adding very small amounts of Ti, Nb, Zr and B which form carbides to strengthen the steel. To obtain an appreciable effect of additon of Al, the Al content should be 0.02 wt% or greater. These carbide formers form, when the steel contains N, pyramidal coarse nitrides such as NbN, TiN, ZrN and BN which impede the formation of fine carbides particularly at high temperature to impair the enhancement of creep rupture strength. By preventing the formation of these nitrides, a strengthening effect is obtained even by addition of very small amounts of these carbide formers, which is equivalent to that obtained by addition of large amounts of the same. On the other hand, when the Al content exceeds 0.25 wt%, the Al dissolves into the steel as metallic Al which unfavourably promotes the coarsening of the crystal grains to lower the creep rupture strength and the creep strength. The Al content, therefore, should not exceed 0.25 wt%. Furthermore, the Al plays an important role as a deoxidizer in the production of large casting by melting and, therefore, is indispensable for obtaining sound steel ingot. The Al content in the range between 0.08 wt% and 0.2 wt% is especially preferable.

Nitrogen contained in the atmosphere is inevitably involved by the steel during melting. The nitrogen exhibits a high affinity to Nb, Ti, Zr and B. In the steel having very small contents of Nb, Ti, Zr and B, therefore, most part of these elements are consumed away because these elements form nitrides or carbonitrides through reaction with the nitrogen. These nitrides or carbonitrides do not contribute at all to the improvement in the creep rupture strength so that the addition of Nb, Ti, Zr and B does not produce any appreciable effect. Therefore, the nitrogen is preferably precluded when these elements are added only by very small amounts. In the ordinary melting process conducted in the atmosphere, the nitrogen is involved by an amount of 0.1 wt% at the maximum. It is, therefore, important to select the amount of additon of Al in accordance with the nitrogen content. The nitrogen content in the steel is ruled by the atmosphere in the melting furnace and is determined, according to experience, by the combination of the type of the furnace and the atmosphere. The amount of addition of Al, therefore, is selected within the range between 0.02 wt% and 0.25 wt% in accordance with the combination of the type of furnace and the atmosphere.

The B content should be 0.001 wt% or greater, in order to improve the creep rupture strength, elongation and reduction of area, particularly the long-time creep rupture strength. To the contrary, the addition of B in excess of 0.01 wt% is not preferred because it impairs the weldability and hot workability. The B content, therefore, is selected not to exceed 0.01 wt%, preferably to fall within the range between 0.002 wt% and 0.006 wt%.

The addition of Nb by an amount of 0.02 wt% or more improves the creep rupture strength through the formation of stable carbides. On the other hand, the addition of Nb in excess of 0.5 wt% impairs the castability, weldability and hot workability, as well as oxidation resistance, and forms coarse carbides to reduce the strength particularly in large-size casting. The Nb content, therefore, should not exceed 0.5 wt% and is preferably selected to range between 0.04 wt% and 0.4 wt%.

The Ta produces almost the same effect as Nb, so that the Nb can be substituted by the same amount of Ta. In general, Nb contains a trace amount of Ta.

The Ti is an element which forms stable carbide to improve the creep rupture strength when added by an amount exceeding 0.01 wt%. As in the case of Nb, or Ta, however, the addition of Ti in excess of 0.2 wt% lowers the castability, weldability and hot workability and, particularly in the case of large-size casting, forms coarse carbide to decrease the strength. The Ti content, therefore, should not exceed 0.2 wt% and is selected preferably to range between 0.05 wt% and 0.15 wt%.

The addition of V in excess of 0.02 wt% improves the strength and corrosion resistance. The V content exceeding 0.6 wt%, however, impairs the weldability and hot workability, as well as oxidation resistance. The V content, therefore, should be selected not to exceed 0.6 wt%.

The austenitic steel in accordance with the invention contains at least one, preferably two or more, of B, Nb, Ti and V. When one of these elements is added solely, the long-time creep rupture strength is lowered due to precipitation of coarse carbide, although the short-time creep rupture strength is improved due to high precipitation rate of carbide at high temperature. In contrast, when two or more of these elements are added together, the rate of formation of carbides is smaller than that obtained when a single element is added, so that the coarsening of the carbides is suppressed to improve also the long-time creep rupture strength.

Examples of the combination of elements to be added simultaneously are: B+Nb, B+Nb+Ti and Nb+Ti. More specifically, in the combination B+Nb, i.e. when B and Nb are added simultaneously, B and Nb contents range between 0.001 wt% and 0.01 wt% and between 0.08 wt% and 0.45 wt%, respectively. More preferably, the B and Nb contents are selected to fall within the ranges between 0.003 wt% and 0.006 wt% and between 0.08 wt% and 0.12 wt%, respectively. In the case of the combination B+Nb+Ti, the T content, Nb content, and Ti content are selected to range between 0.002 wt% and 0.007 wt%, between 0.03 wt% and 0.25 wt%, and between 0.05 wt% and 0.12 wt%, respectively. Particularly, it is preferred that the sum of Nb and Ti contents ranges between 0.16 wt% and 0.24 wt%. In the case of the combination Nb+Ti, the Nb and Ti contents are preferably selected to range between 0.03 wt% and 0.25 wt% and between 0.05 wt% and 0.12 wt%, respectively. The sum of the Nb and Ti contents preferably ranges between 0.16 wt% and 0.24 wt%.

The amount of addition of Al should be optimized in relation to the nitrogen content which varies depending on the type of the melting furnace and the atmosphere in which the steel is molten. A high strength is obtained when the ratio Al(wt%)/N(wt%) takes a value between 1 and 4.5, preferably between 1.5 and 3.5. The highest strength is obtained when this ratio takes a value ranging between 2 and 3. Al forms AlN through reaction with N. In order to perfectly fix N by Al, it is necessary that the Al content by weight is 1.9 times as large as N content. Therefore, if the Al content is 1 to 1.9 times as large as the N content, a part of N remains unfixed in the steel to react with the carbide formers to form nitrides and carbonitrides. However, since the amount of the unfixed nitride is very small, the nitrides and carbonitrides do not become coarse and contribute to the increase in the strength. On the other hand, if the Al content is 1.9 to 4.5 times as large as the N content, metallic Al remains in the steel as a dissolved Al. A very small amount of dissolved Al, however, effectively fixes the nitrogen which is absorbed during use in the atmosphere at high temperature thereby to contribute to the increase in the strength. However, if the Al content is below the N content, i.e. if the above-mentioned weight ratio takes a value not greater than 1, a considerably large amount of N remains unfixed in the steel to form nitrides and carbonitrides through reaction with the carbide formers such as Ti, Nb, Zr and B to impair the effect obtained by the addition of very small amounts of these carbide formers. To the contrary, when the Al content exceeds 4.5 times of the N content, growth of carbide is promoted due to a too much amount of dissolved Al, so that such large Al content does not make substantial contribution to the increase in the strength.

The dissolved metallic Al provides, when its content is not greater than 0.012 wt%, an extremely low creep rate. The creep rate is decreased as the content of dissolved Al is decreased and the best result is obtained when the content of dissolved Al is zero. The content of dissolved Al should not exceed 0.012 wt%, because when it exceeds that value the creep rate becomes high drastically. The content of the dissolved Al is drastically increased when the aforementioned weight ratio Al/N exceeds about 2 but the maximum value of this content is 0.014 wt%. It is, therefore, considered that the content of dissolved Al is not substanially influenced by the amount of addition of Al.

A proper amount of AlN formed in the steel prevents the growth of the austenite crystal grains to make them fine. The addition of the Al is made in advance of the addition of the carbide formers and, preferably, also after the deoxidation.

The addition of Cu by an amount not greater than 4 wt% is necessary for improving the high-temperature strength. On the other hand, the addition of Cu in excess of 4 wt% causes an embrittlement of the grain boundary at high temperature and undesirably increases the sensitivity to hot weld crack. The Cu content, therefore, should not exceed 4 wt%, and is preferably selected to range between 2 wt% and 2.5 wt%. When Cu is added, the sum of the Ni content and the Cu content does not exceed 20 wt% preferably.

DESCRIPTION OF THE PREFERRED EMBODIMENTS

Figure 1:
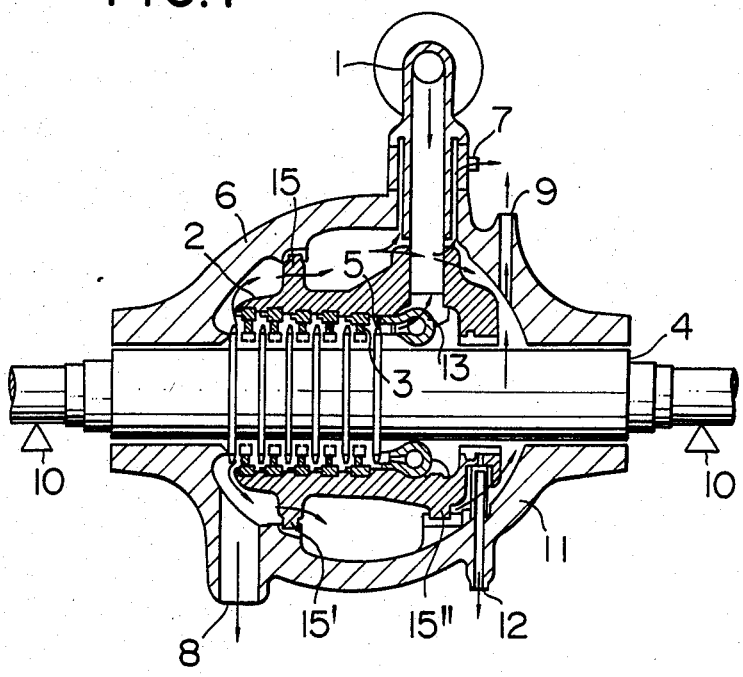
FIG. 1 is a sectional view of a steam turbine casing made of a steel in accordance with the invention.

As stated before, the steel of the invention can suitably be used for the turbine casing of a super critical pressure steam turbine, valve body for use in such steam turbine, and styrene synthesizing tower.

The turbine casing for super critical pressure steam turbine is composed of an inner casing made from a steel of the invention and an outer casing made from a Cr—Mo—V steel.

The inner casing and the valve body according to the present invention are made from a casing of a high-strength austenitic steel having a fully austenite structure and consisting essentially of 0.02 to 0.15 wt% of C, not greater than 1.5 wt% of Si, not greater than 2.5 wt% of Mn, 8 to 20 wt% of Ni, 13 to 25 wt% of Cr, 0.02 to 0.25 wt% of Al, not greater than 0.1 wt% of N, 0.001 to 0.01 wt% of B, 0.02 to 0.5 wt% of Nb, 0.1 to 0.2 wt% of Ti and the balance substantially Fe, with the weight ratio (Al/N) ranging between 1 and 4.5. More specifically, the preferable steel used as the material of the inner casing and the valve body is a high-strength austenitic steel consisting essentially of 0.06 to 0.13 wt% of C, 0.4 to 1.0 wt% of Si, 1 to 2 wt% of Mn, 10 to 15 wt% of Ni, 15 to 20 wt% of Cr, 0.08 to 0.23 wt% of Al, 0.01 to 0.07 wt% of N, and above-mentioned B, Nb and Ti, with the weight ratio (Al/N) ranging between 1.5 and 3.5.

The steam comes through a main steam pipe 1 and is injected in a predetermined direction through stationary blades 3 mounted in the inner casing 2 so as to act on moving balades 5 mounted on a rotor shaft 4 to rotate the latter. The steam expanded through the turbine passes through the space defined between an outer casing 6 and the inner casing 2 and is discharged through a cooled steam outlet 7, exhaust steam outlet 8 and an auxiliary steam outlet 9. The steam is then forwarded to another steam turbine which operates at a lower steam temperature. A reference numeral 10 designates the centers of bearings which support the rotor shaft, 11 denotes a gland, 12 denotes an intermediate grand leak outlet and 13 denotes a nozzle box. The flow of steam is indicated by arrows.

As stated before, the inner casing is made from a Cr—Ni austenitic cast steel of the invention, while the rotor shaft is made from an austenitic forged steel having higher Cr and Ni contents than the steel of the invention. The outer casing is made from a Cr—Mo—V cast steel as explained before.

More specifically, FIG. 1 shows a super critical pressure steam turbine to which the steel of the invention is applied as a material. This turbine is adapted to operate with steam having a temperature of 650° C. and a pressure of 350 Kg/cm$^2$. As will be seen from this Figure, a plurality of stages of moving blades 5 are mounted on the rotor shaft 4 and a plurality of stationary blades 3 fixed to the inner casing 2 are disposed between each adjacent stages of the moving blades 5. The inner casing 2 is provided with a plurality of projections 15, 15',15" which fit in corresponding recesses formed in the outer casing 6 so that the inner casing 2 is fixed to the outer casing 6. The inner casing is subjected to steam having a temperature of 554° to 650° C. and a pressure of 199 to 350 Kg/cm$^2$, while the outer casing is subjected to steam having a temperature of 554° C. and a pressure of 199 Kg/cm$^2$.

The inner casing is made by a process which has the steps of melting the material by vacuum deoxidation method, casting in a sand mold followed by a slow cooling, and effecting a solid solution treatment by heating it to and holding it at 1000° to 1100° C. for 30 minutes per 1 inch of wall thickness followed by quenching through immersion in stirred water.

Figure 2:
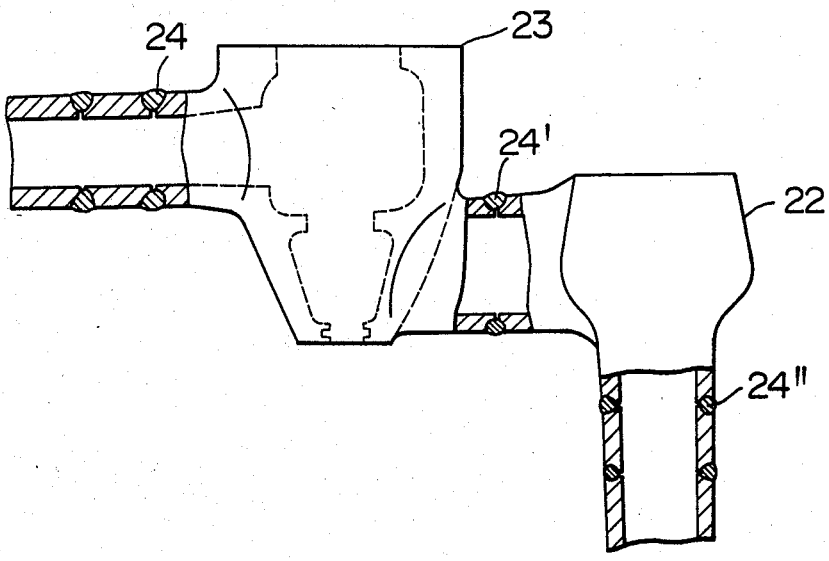
FIG. 2 is a front elevational view of a valve body made of a steel in accordance with the invention.

FIG. 2 is a front elevational view of a valve body used in the steam turbine. This valve body also is made from a steel of the invention. The steam comes into a main stop valve 23 and is introduced into the turbine through a regulating valve 22. The bodies of these valves are connected by welding as at 24, 24',24". The valve bodies are made from cast steel as in the case of the inner casing and are produced by the same process as the inner casing.

The welding is conducted with a welding rod which produces a deposited metal having a fully austenite structure and consisting essentially of 0.03 to 0.15 wt% of C, 0.1 to 1.0 wt% of Si, 1.0 to 3.0 wt% of Mn, 8 to 13 wt% of Ni, 15 to 23 wt% of Cr, not greater than 0.03 wt% of P, not greater than 0.03 wt% of S, 0.5 to 2.0 wt% of Co and the balance substantially Fe. Preferably, a stress relief annealing is conducted after the welding.

Figure 3:
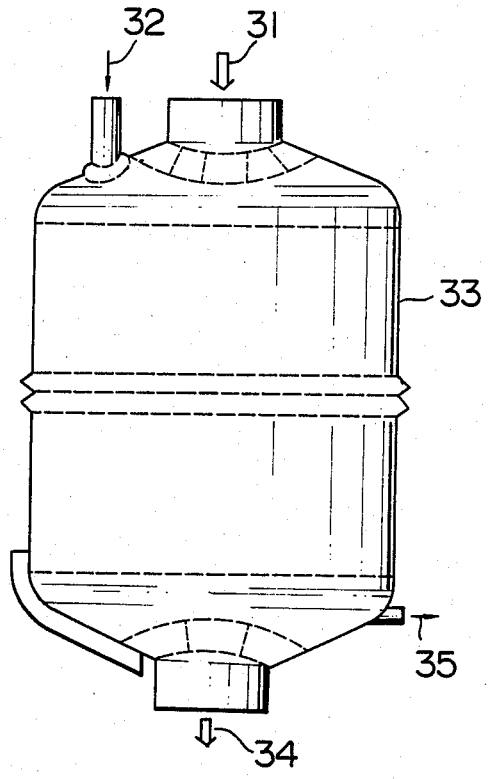
FIG. 3 is a front elevational view of a styrene synthesizing tower made of a steel in accordance with the invention.

FIG. 3 is a front elevational view of a styrene monomer synthesizing tower, the major part of which is made from a steel of the invention. The styrene monomer synthesizing tower has a styrene making vessel body 33. A combustion gas inlet nozzle 31 and a gas outlet nozzle 34 are connected by welding to the centers of the upper and lower sides of the body 33. Also, a benzene inlet nozzle 32 and a benzene outlet nozzle 35 communicating with a reaction pipe in the vessel are connected to the upper and lower sides of the body 33 by welding. The combustion gas of, for example, 700° to 800° C. comes into the gas inlet nozzle 31. The gas temperature has been lowered to 600° to 700° C. when the gas leaves the vessel at the outlet nozzle 34. On the other hand, benzene of 600° to 650° C. is introduced into the reaction pipe through the benzene inlet nozzle 32 and is heated while it flows through the reaction pipe by the combustion gas flowing outside the reaction pipe. The heated benzene is discharged through the outlet nozzle 35. In FIG. 3, the broken lines show the weld zones.

The styrene synthesizing tower of the invention is made from a forged and/or rolled sheet of a steel having fully austenite structure and consisting essentially of 0.02 to 0.15 wt% of C, not greater than 1.5 wt% of Si not greater than 2.5 wt% of Mn, 8 to 20 wt% of Ni, 13 to 25 wt% of Cr, 0.02 to 0.25 wt% of Al, not greater than 0.1 wt% N, 0.001 to 0.01 wt% of B, 0.02 to 0.5 wt% of Nb, 0.01 to 0.2 wt% of Ti and the balance substantially Fe, with the weight ratio (Al/N) ranging between 1 and 4.5. Preferably, the steel used as the material of this styrene synthesizing tower is a steel consisting essentially of 0.06 to 0.1 wt% of C, 0.4 to 1.0 wt% of Si, 1 to 2 wt% of Mn, 10 to 15 wt% of Ni, 15 to 20 wt% of Cr. 0.08 to 0.23 wt% of Al, 0.01 to 0.07 wt% of N, and the above-mentioned B, Nb and Ti, with the weight ratio (Al/N) ranging between 1.5 and 3.5, and most preferably the steel contains 0.5 to 4.0 wt% of Cu in addition to these constituents.

The styrene synthesizing tower of the invention made from the steel of the invention is fabricated by welding. The welding is conducted with a welding rod which produces a deposited metal having a fully austenite structure and consisting essentially of 0.03 to 0.15 wt% of C, 0.1 to 1.0 wt% of Si, 1.0 to 3.0 wt% of Mn, 8 to 13 wt% of Ni, 15 to 23 wt% of Cr, not greater than 0.03 wt% of P, not greater than 0.03 wt% of S, and the balance substantially Fe. The deposited metal may contain, in addition to these constituents, 0.5 wt% to 2.0 wt% of Co. Preferably, a stress relief heat treatment is conducted after the welding.

The steel of the invention offers the following advantages. Namely, since very small amounts of carbide formers are added to Cr—Ni austenitic steel, the weldability and the castability of the steel are not impaired. In addition, the undesirable formation of nitrides and carbonitrides of these carbide formers is effectively prevented, so that a high creep rupture strength of the austenitic steel is ensured.

The steel of the invention can be used for various other uses than those described, e.g. the materials for the nuclear fuel cladding tube, cryogenic vessel and so forth.

EXAMPLES

Table 1 shows the chemical compositions (wt%) of samples used in a test. Sample Nos. 1 to 3 and 6 to 10 show the steels of the invention, while sample Nos. 4 and 5 show the comparison steels. Sample No. 11 shows a commercially available SUS 316 steel as specified by JIS. More specifically, the steels of sample Nos. 1 to 3 are cast steel produced by melting in a high frequency melting furnance and cast into ingot of 100 mm×120 mm×200 mm, while other steels are forged steel forged at a forging ratio of 5.5. The cast steels of sample Nos. 1 to 3 have been subjected to a solid solution treatment which consists of water cooling after 5-hour heating at 1050° C., while other steels have been subjected to a solid solution treatment consisting of water cooling after 2-hour heating at the same temperature. All of the samples had crystal grain sizes smaller than that specified by JIS 0551#2. In the melting process, the addition of the carbide formers Ti, Nb, B and V was conducted after the addition of Al. The Cu appearing in the sample No. 1 in Table 1 has been included as an impurity.

Figure 4:
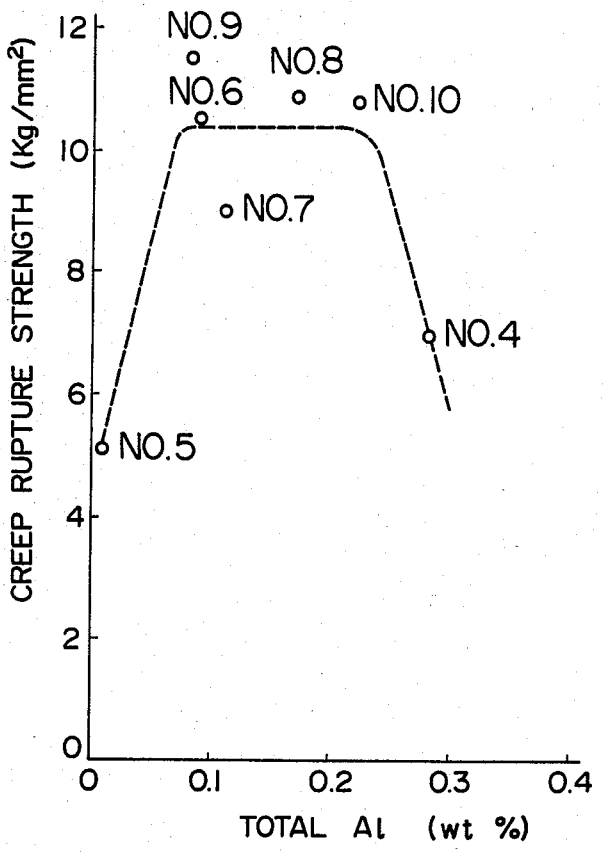
FIG. 4 is a diagram showing the relationship between the creep rupture strength and the total Al content in a steel.

FIG. 4 is a diagram showing the relationship between the 650° C., $10^5$-hour creep rupture strength of a steel and the total Al content of the steel. As will be seen from this Figure, a high creep rupture strength exceeding about 8.5 Kg/mm$^2$ is obtained when the total Al content ranges between 0.05 wt% and 0.25 wt%. The highest creep rupture strength is observed when the total Al content ranges between 0.08 wt% and 0.20 wt%.

Figure 5:
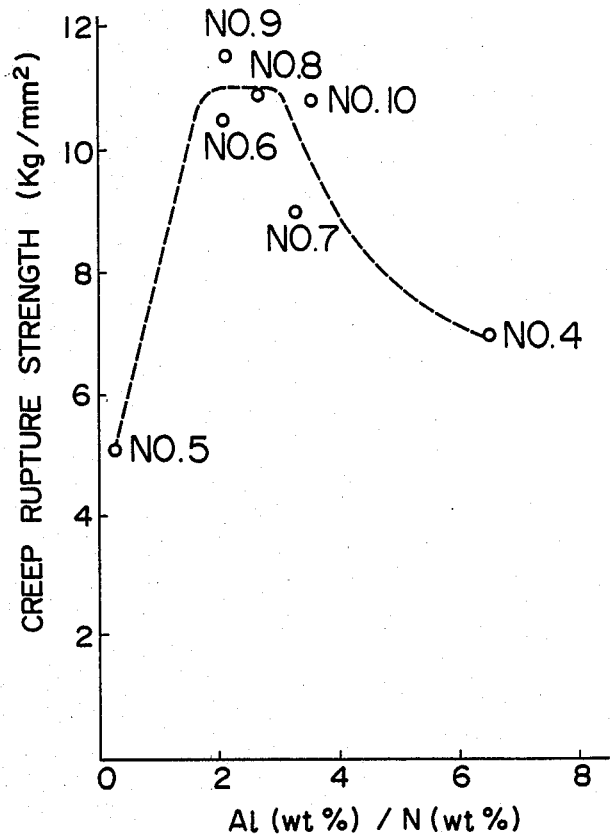
FIG. 5 is a diagram showing the relationship between the creep rupture strength and the weight ratio Al/N

FIG. 5 shows the relationship between the 650° C., $10^5$-hour creep rupture strength and the weigh tratio (total Al/N) of the steel. It will be understood that a high creep rupture strength exceeding about 8 Kg/mm$^2$ is obtained when the value of this weight ratio ranges between 1 and 4.5, and the highest creep rupture strength of 10.5 Kg/mm$^2$ or higher is obtained when the value of the ratio is between 2 and 3.

TABLE 1

| No. | C | Si | Mn | P | S | Ni | Cr | Al total | Al sol | B | Nb + Ta | Ti | Others | N | Al/N |
|---|---|---|---|---|---|---|---|---|---|---|---|---|---|---|---|
| 1 | 0.06 | 0.84 | 1.63 | 0.031 | 0.021 | 13.77 | 15.46 | 0.13 | 0.007 | 0.0032 | 0.07 | 0.09 | Cu 0.10 | 0.062 | 2.1 |
| 2 | 0.07 | 0.49 | 1.75 | 0.020 | 0.011 | 10.71 | 16.73 | 0.08 | 0.003 | — | 0.35 | — | V 0.44 | 0.035 | 2.3 |
| 3 | 0.12 | 0.42 | 1.95 | 0.015 | 0.010 | 10.75 | 16.38 | 0.12 | 0.006 | — | 0.20 | — | Cu 2.22 V 0.44 Cu 0.10 | 0.058 | 2.1 |
| 4 | 0.06 | 0.80 | 1.65 | 0.026 | 0.020 | 13.78 | 15.44 | 0.28 | 0.014 | 0.004 | 0.04 | 0.11 | — | 0.043 | 6.5 |
| 5 | 0.07 | 0.76 | 1.64 | 0.028 | 0.018 | 13.77 | 15.37 | 0.01 | 0.003 | 0.004 | 0.03 | 0.09 | — | 0.037 | 0.3 |
| 6 | 0.08 | 0.93 | 1.83 | — | — | 11.95 | 18.25 | 0.09 | 0.009 | 0.005 | 0.35 | — | — | 0.042 | 2.1 |
| 7 | 0.07 | 0.66 | 1.71 | 0.28 | 0.006 | 10.76 | 18.04 | 0.11 | — | — | 0.10 | 0.07 | — | 0.033 | 3.3 |
| 8 | 0.13 | 0.40 | 1.97 | — | — | 11.00 | 16.30 | 0.17 | — | — | 0.21 | — | V 0.41 | 0.065 | 2.6 |
| 9 | 0.07 | 0.90 | 1.75 | 0.025 | — | 14.00 | 16.00 | 0.08 | 0.012 | 0.003 | 0.04 | 0.10 | — | 0.037 | 2.2 |
| 10 | 0.10 | 0.56 | 1.19 | — | — | 12.00 | 16.60 | 0.22 | 0.014 | 0.005 | 0.22 | — | V 0.25 | 0.062 | 3.5 |
| 11 | 0.04 | 0.74 | 1.74 | 0.038 | 0.008 | 13.80 | 17.50 | 2.70 | — | — | — | — | — | — | — |

Table 2 shows the elongation and the reduction of area as observed after the 650° C., 1000-hour creep rupture.

Sample Nos. 1 to 3, which are the cast steels, inevitably show inferior elongation and reduction of area to those exhibited by other samples of forged steels. The steels of the sample Nos. 6 to 10, which are the forged steels of the invention, showed an elongation equivalent to that of the conventional material of the sample No. 11.

TABLE 2

| No. | elongation (%) | reduction of area (%) |
|---|---|---|
| 1 | 28 | 50 |
| 2 | 11 | 30 |
| 3 | 9 | 16 |
| 4 | 40 | — |
| 5 | 38 | — |
| 6 | 35 | — |
| 7 | 30 | — |
| 8 | 33 | — |
| 9 | 38 | — |
| 10 | 21 | — |
| 11 | 31 | 72 |

In the welded structures which are intended for long term service at a higher temperature in a creep temperature range, it is a quite important requisite to reduce the thermal stress and the residual stress particularly in the weld zone. Therefore, the materials applied to such zone are required to have a creep elongation of 20% or greater, in order to facilitate the relief of the thermal stress and residual stress. The forged steels and rolled steels in accordance with the invention well satisfy this requirement and, hence, can be applied to welded structures without substantial problem.

Figure 6:
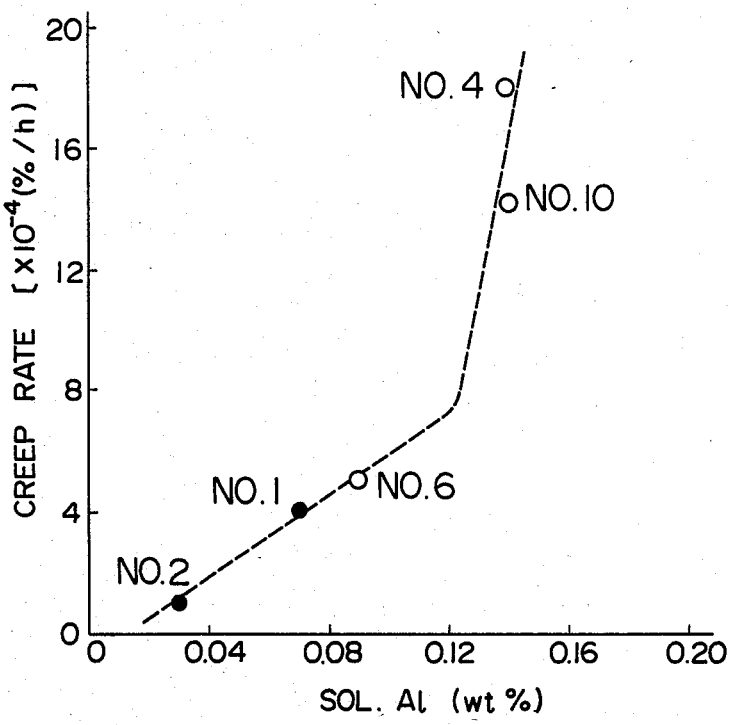
FIG. 6 is a diagram showing the relationship between the creep rate and the soluble Al.

FIG. 6 is a diagram showing the relationship between the creep rate and the content of dissolved Al as observed in a creep test conducted under the condition of 600° C. and 5 Kg/mm$^2$. The content of dissolved Al starts to increase drastically when the value which is obtained by subtracting a value 1.9 times as large as N content from the total Al content exceeds zero, and saturates substantially at 0.014 wt%. The creep rate is drastically increased as the dissolved Al content is increased. More specifically, the creep rate takes a small value around $8\times10^{-4}$ (%/h) when the dissolved Al content is below 0.12 wt%, but drastically increases as this value of dissolved Al content is exceeded.

Figure 7:
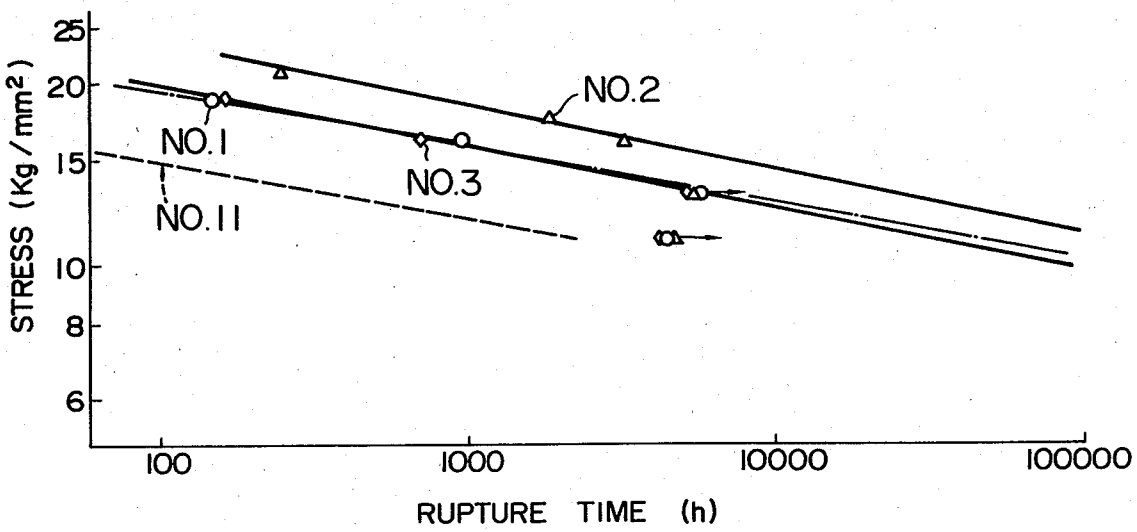
FIG. 7 is a diagram showing the results of creep rupture tests.

FIG. 7 is a diagram showing 650° C. creep rupture curves. It will be understood from this Figure that the steels of the invention identified by the sample Nos. 1 to 3, improved by the addition of B, Nb+Ta, Ti, V and Cu, exhibit creep rupture strengths which are about 30% higher than that of the conventional steel sample No. 11. Particularly, the steel sample Nos. 1 and 3 of the invention show a $10^3$-hour rupture strength of 16 Kg/mm$^2$ which is about 4 Kg/mm$^2$ higher than that (about 12 Kg/mm$^2$) of the conventional steel sample No. 11.

Table 3 shows the properties of the steels of the invention in comparison with those of the Cr—Mo—V cast steel which is used broadly as the steam turbine casing material. It will be seen that the steels of the invention show creep rupture strength of 8 Kg/mm$^2$ or greater at 650° C., which is higher than that shown by the conventional Cr—Mo—V cast steel at 566° C. In addition, the steels of the invention exhibit tensile strength at room temperature of 50 Kg/mm$^2$ or greater which is higher than that shown by the conventional Cr—Mo—V cast steel at room temperature. It was thus confirmed that the steel of the invention can be used satisfactorily as the material of the turbine casing of a super critical pressure steam turbine which operates with steam of extremely high temperature and pressure of 600° to 650° C. and 350 Kg/cm$^2$. It was also confirmed that the steel of the invention has a sufficiently high absorbed energy of an order of 10 Kgf-m or greater.

TABLE 3

| items | Cr—Mo—V cast steel | steel of invention No. 1 | No. 2 | No. 3 |
|---|---|---|---|---|
| $10^5$-hour creep rupture strength [Kg/mm$^2$] | 7.7–9.5 | 8.0 | 9.6 | 8.0 |
| impact strength [Kgf-m] | — | 19.4 | 10.0 | 16.0 |
| tensile strength (at room temp.) [Kgf/mm$^2$] | 56.2 | — | 57.3 | 56.5 |

The Cr—Mo—V cast steel had a chemical composition (wt%) as shown in Table 4, and was subjected to a heat treatment having the steps of 9-hour heating at 1050° C., hardening by cooling at a rate of 400° C./hr, and 15-hour heating at 710° C. followed by cooling in the furnace. In Table 3, the creep rupture strength of the Cr—Mo—V cast steel is shown to have a certain region of fluctuation with the minimum value of 7.7 Kg/mm$^2$. The standard requires that the creep rupture strength does not fall short of this lower limit value.

The steel of the invention identified by the sample No. 2, containing about 2 wt% of Cu, showed creep rupture strength and tensile strength at room temperature higher than those of other steels.

TABLE 4

| C | Si | Mn | P | S | Cu | Ni | Cr | Mo | V | Al | Ti |
|---|---|---|---|---|---|---|---|---|---|---|---|
| 0.18 | 0.45 | 0.63 | 0.016 | 0.011 | 0.013 | 0.23 | 1.09 | 1.00 | 0.25 | 0.009 | 0.024 |

What is claimed is:

1. A high-strength austenitic steel having a fully austenite structure and consisting essentially of 0.06 to 0.15 wt% of C, not greater than 1.5 wt% of Si, not greater than 2.5 wt% of Mn, 10 to 15 wt% of Ni, 13 to 25 wt% of Cr, 0.08 to 0.20 wt% of Al, 0.033 to 0.10 wt% of N, at least one of 0.001 to 0.01 wt% of B, 0.02 to 0.5 wt% of Nb, 0.01 to 0.2 wt% of Ti and 0.02 to 0.6 wt% of V and the balance substantially Fe, with the weight ratio (Al/N) ranging between 1.5 and 3.5; said steel exhibiting a 650° C., $10^5$-hour creep rupture strength of at least 9 Kg mm$^2$.

2. A high-strength austenitic steel according to claim 1, consisting essentially of 0.06 to 0.13 wt% of C, 0.4 to 1.0 wt% of Si, 1 to 2 wt% of Mn, 10 to 15 wt% of Ni, 15 to 20 wt% of Cr, 0.08 to 0.20 wt% of Al, 0.033 to 0.07 wt% of N, at least two of 0.001 to 0.01 wt% of B, 0.02 to 0.5 wt% of Nb, 0.01 to 0.2 wt% of Ti and 0.02 to 0.6 wt% of V and the balance substantially Fe, with the weight ratio (Al/N) ranging between 1.5 and 3.5.

3. A high-strength austenitic steel according to either one of claims 1 and 2 containing at least two of 0.002 to 0.007 wt% of B, 0.06 to 0.20 wt% of Nb, 0.06 to 0.15 wt% of Ti and 0.2 to 0.45 wt% of V and the balance substantially Fe.

4. A high-strength austenitic steel according to either one of claims 1 and 2, containing 0.001 to 0.01 wt% of B and 0.008 to 0.45 wt% of Nb, with the weight ratio (Nb/C) ranging between 3 and 6.

5. A high-strength austenitic steel according to either one of claims 1 and 2, containing 0.002 to 0.007 wt% of B, 0.03 to 0.25 wt% of Nb and 0.05 to 0.12 wt% of Ti, with the weight ratio {(Nb+2Ti)/C} ranging between 3 and 6.

6. A high-strength austenitic steel according to either one of claims 1 and 2, containing 0.03 to 0.25 wt% of Nb and 0.05 to 0.12 wt% of Ti, with the weight ratio {(Nb+Ti)/C} ranging between 3 and 6.

7. A high-strength austenitic steel according to any one of claims 1 to 6, containing at least two of B, Nb, Ti and V in their respective said contents wherein the content of dissolved Al is not greater than 0.012 wt%.

* * * * *